United States Patent [19]

Love

[11] 4,429,681

[45] Feb. 7, 1984

[54] FIREPLACE GRATE ADAPTER

[76] Inventor: Samuel D. Love, 13510 Old Indian Head Rd., Brandywine, Md. 20613

[21] Appl. No.: 274,269

[22] Filed: Jun. 16, 1981

[51] Int. Cl.[3] ..... F23H 13/00

[52] U.S. Cl. ..... 126/152 B; 126/164

[58] Field of Search ..... 126/152 R, 152 A, 152 B, 126/164, 165, 298, 336, 201, 202

[56] References Cited

U.S. PATENT DOCUMENTS

| | | | |
|---|---|---|---|
| 137,993 | 4/1873 | Woodcock | 126/164 |
| 757,067 | 4/1904 | Stewart | 126/164 |
| 1,389,792 | 9/1921 | Tatum | 126/164 |
| 4,262,651 | 4/1981 | Fajt . | |

*Primary Examiner*—James C. Yeung

*Attorney, Agent, or Firm*—Parkhurst & Oliff

[57] ABSTRACT

A fireplace grate adapter attached to or integral with a fireplace grate and having a spacing means for contacting the back wall of a fireplace. The adapter can maintain the grate at a desired distance from the back wall of the fireplace, and is preferably provided with a support system for preventing objects from falling behind the fireplace grate.

14 Claims, 5 Drawing Figures

FIREPLACE GRATE ADAPTER

BACKGROUND OF THE INVENTION

1. Field of the Invention

This invention relates to fireplace grate assemblies, and more particularly, to fireplace grate assemblies wherein an adapter is provided for the grate to insure that the grate is kept at a certain distance from the back of the fireplace. Even more particularly, this invention relates to fireplace grate adapters also having means to prevent logs and other heavy objects from falling behind the grate. The present invention is particularly useful for use in fireplaces utilizing a fireplace draft control as described in my co-pending U.S. Patent Application of Apr. 22, 1981. It should be noted that the present fireplace grate adapter is not limited to such a use.

2. Description of the Prior Art

In the past, fireplace grates have not been provided with means limiting their movement towards the back of the fireplace in which they are situated. Also, nothing has been provided to prevent logs or other heavy objects from falling behind the grate. Thus, when a fireplace draft control or other device has been provided behind the grate, it has been subject to unneccessary damage resulting from the grate being accidentally pushed back into the draft control or from logs or other objects falling behind the grate and on top of the draft control.

SUMMARY OF THE INVENTION

It is an object of this invention to provide a fireplace grate adapter which can prevent a grate from being pushed too close to the rear wall of a fireplace.

It is a further object of this invention to provide a fireplace grate adapter which can prevent heavy objects from falling behind the fireplace grate.

It is a still further object of this invention to provide a fireplace grate adapter which is of simple, economical, and efficient manufacture.

It is a still further object of this invention to provide a fireplace grate adapter which may be integrally cast with new fireplace grates.

The above objects and others are obtained by providing a fireplace grate adapter which attaches to the rear of the fireplace grate. The body of the fireplace grate adapter is provided with an adjustable spacing member which contacts the rear wall of the fireplace. Apertures are provided in the body of the fireplace grate adapter to hold a U-shaped support from which support members extend, keeping objects from falling behind the fireplace grate. The adapter is such that it may be integrally cast with new fireplace grates.

DESCRIPTION OF A PREFERRED EMBODIMENT

Figure 1:
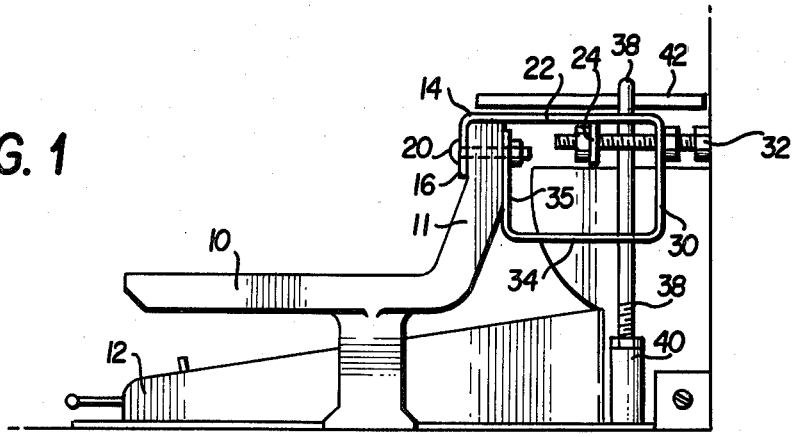
FIG. 1 shows a fireplace grate adapter of the present invention in a fireplace.
Figure 2:
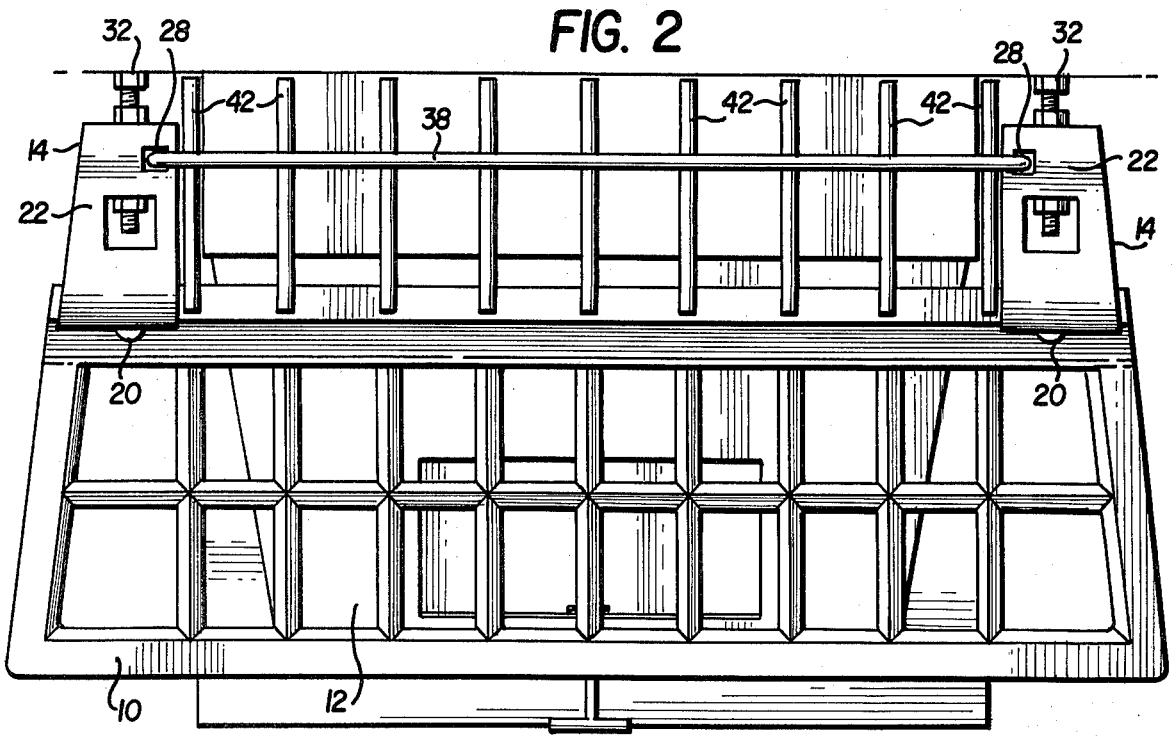
FIG. 2 shows a top view of a fireplace grate and fireplace grate adapter of FIG. 1.
Figure 3:
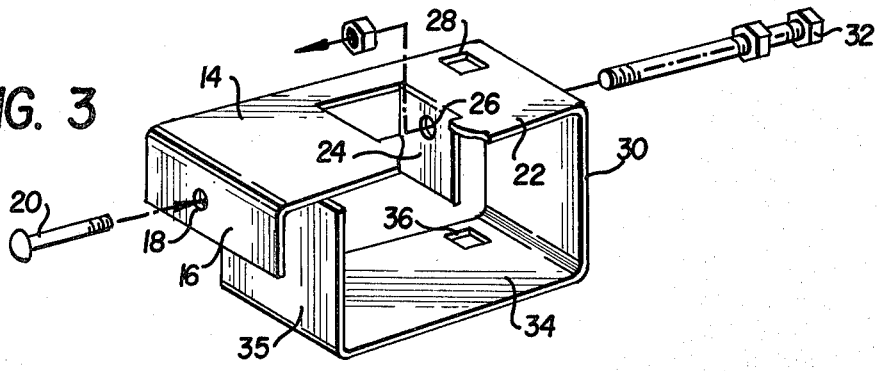
FIG. 3 shows a fireplace grate adapter of the present invention apart from a fireplace grate.

Referring to FIGS. 1 through 3, there is shown a fireplace grate adapter for use with presently existing fireplace grates. The fireplace is provided with a grate 10 having a substantially vertical section 11 and a draft control 12. Grate adapter 14 is used to maintain the grate 10 at the optimum position with respect to draft control 12 and to prevent grate 10 from being accidentally pushed into the draft control 12. The adapter is also provided with a protector to prevent heavy objects from falling behind the grate and on top of the draft control.

The adapter 14 will now be described in greater detail. The fireplace grate adapter 14 is provided with a first vertical member 16 through which aperture 18 extends. First horizontal member 22 extends from the upper end of the vertical member 16, and has a vertically downwardly extending cut out section 24 with aperture 26, and an aperture 28. Second vertical member 30 extends downwardly from the first horizontal member and is provided with an aperture (not shown) aligned with aperture 26 of the cut out section. A second horizontal section 34, having a length less than that of first horizontal member 22, extends from the lower end of the second vertical member 30 towards first vertical member 16. Second horizontal member 34 is provided with an aperture 36 which is aligned with aperture 28 of the first horizontal member. A third vertical member 35 extends upwardly from the end of the second horizontal member and has a length less than that of the second vertical member. Third vertical member 35 is provided with an aperture (not shown) aligned with aperture 18 of the first vertical member 16.

The first, second and third vertical members, the first and second horizontal members, and the cut out section make up the body of the adaptor. The body may advantageously be formed by bending sheet metal. Although the illustrated body construction is the preferred one, it is clear that certain elements, such as the third vertical and second horizontal members, could be eliminated without destroying the functionality of the device.

Nut and bolt 20 extend through the aperture 18 and the aperture of the third vertical member to fasten the adapter 14 to the fireplace grate 10, preferably at the vertical portion 11. Although a nut and bolt assembly has been shown, it is clear that any other means of attachment known in the art would be suitable for the purposes of this invention. Spacing means 32, shown here as a nut, bolt and locknut assembly, contacts the rear wall of the fireplace. The nut, bolt and locknut assembly is utilized to provide a securely mounted yet adjustable spacer, but other spacing means, whether adjustable or not, could also be used in the present invention.

A U-shaped support 38 extends through apertures 28 and 36 in the first and second horizontal members respectively. The U-shaped support is preferably threaded at its end and screwed into base 40, which rests on the floor of the fireplace to provide an anchor for the U-shaped support 38. A suitable material for the U-shaped support would be a very heavy gauge wire, although other materials would also work in the present invention. Attached to the horizontal section of the U-shaped support 38 are support members 42. They are preferably welded onto support 38, and have one end resting on or near the top of the fireplace grate. It would also be possible to replace the individual support members 42 with a single, continuous support member. The support member 42 may be made of heavy gauge wire similar to that of the U-shaped support 38, or any other suitable material. The support members 42 protect the draft control 12 from logs or any other objects which could fall behind the fireplace grate and damage the draft control. Of course, the U-shaped support 38, base 40 and support members 42 could be eliminated if the only function desired was that of maintaining the grate 10 at an optimum distance from the rear wall of the fireplace.

Figure 4:
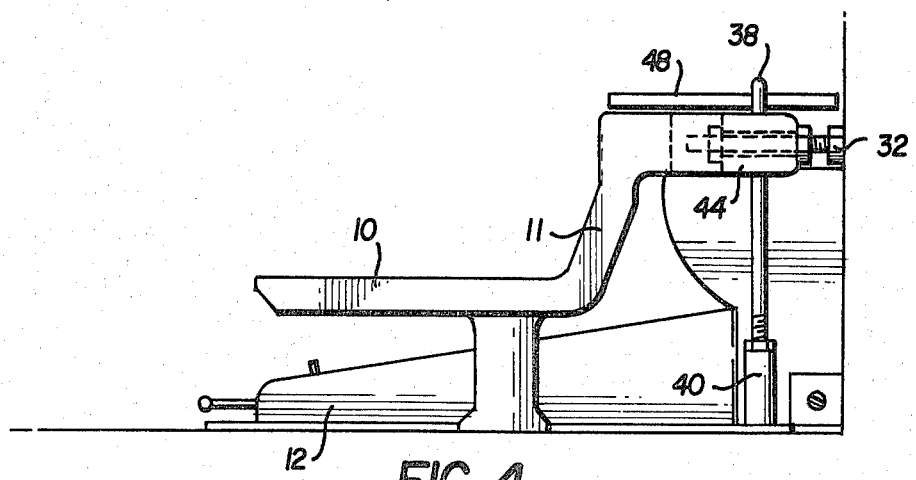
FIG. 4 shows a second embodiment of a fireplace grate adapter of the present invention wherein the adapter has been integrally cast with the fireplace grate.
Figure 5:
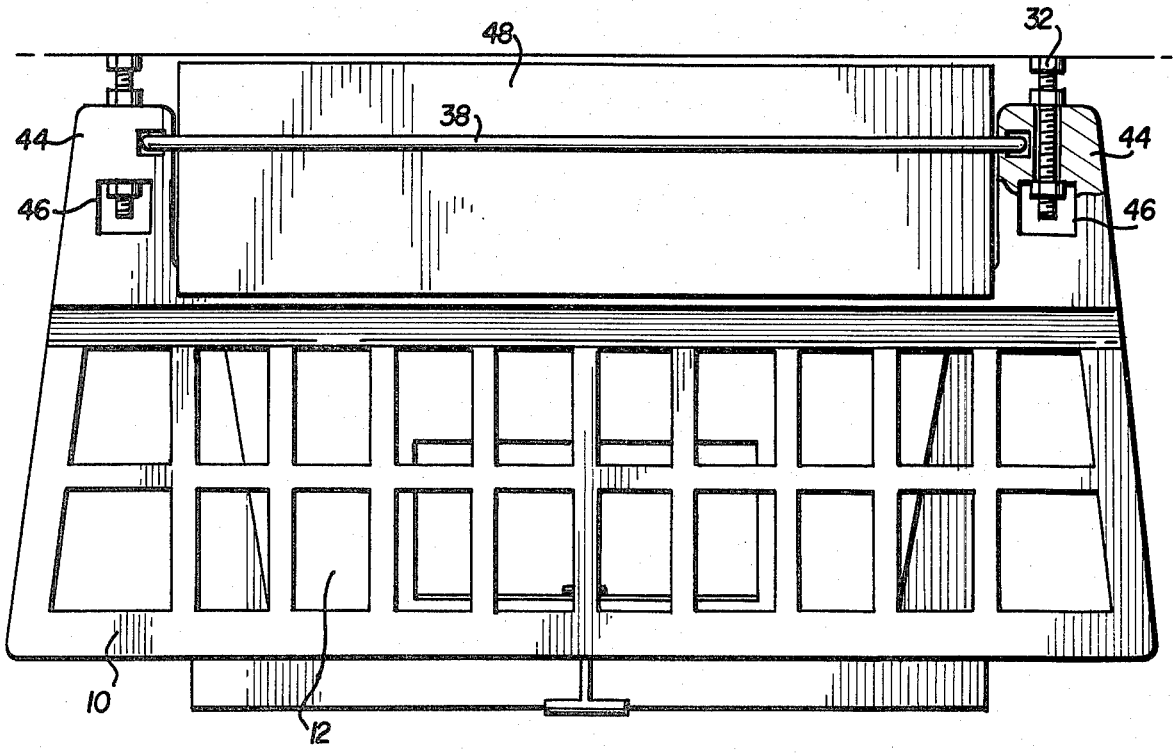
FIG. 5 shows a top view of the fireplace grate of FIG. 4.

Referring now to FIGS. 4 and 5, a second embodiment of the present invention is shown. In this embodiment, the adapter 44 has been integrally cast with the upper portion 11 of the grate. The space 32 functions in a manner identical to that of the first embodiment. An aperture 46 is provided in the adapter 44 to provide easy access to the spacer 32. The U-shaped support 38 also functions in the same manner as in the first embodiment, but there is shown a continuous support member 48 instead of the several individual support members 42 of the first embodiment. While the embodiments shown have illustrated the use of two adapters 14 with the fireplace grate 10, it should be clear that only one might be necessary, or more might be desirable, depending upon the particular application.

The present invention thus provides an adapter which can maintain the fireplace grate at whatever distance is desired from the rear wall of the fireplace, and may be provided with a support for preventing objects from falling behind the fireplace grate. The above description is intended to exemplify the present invention and not limit the scope or spirit thereof which is defined in the following claims.

What is claimed is:

1. A fireplace grate adapter for use in a fireplace, comprising:

a body portion, comprising:

a substantially horizontal member, a substantially vertical member connected with said substantially horizontal member, and an aperture means in one of said substantially horizontal and vertical members;

attachment means for attaching said body portion to a fireplace grate; and adjustable spacing means attached to said body portion and extending through said aperture means, said adjustable spacing means contacting the back wall of a fireplace thus allowing the grate to be held at an adjustable distance from the back wall of the fireplace.

2. An adapter as claimed in claim 1, wherein said body portion further comprises a second aperture means in one of said substantially horizontal and vertical members, and a U — shape support extending through said second aperture means for protecting a draft control on the floor of the fireplace.

3. An adapter as claimed in claim 2, wherein said U-shaped support has a horizontal section, and a support member extends substantially horizontally from the horizontal section of said U-shaped support.

4. An adapter as in claim 2, wherein the U-shaped support extends through said second aperture means to the floor of the fireplace, the U-shaped support being supported by the fireplace floor.

5. A fireplace grate adapter as in claim 1, in combination with a separate draft control means for controlling the amount of draft air supplied to the fireplace, the draft control means extending at least partially into the space between the grate and the back wall of the fireplace.

6. A combination fireplace grate adapter and draft control as in claim 5, wherein the body portion has a second aperture, further comprising a U-shaped support member extending through said second aperture.

7. A fireplace grate adapter, comprising:

a body portion, comprising:

a horizontal member; and an apertured vertical member connected to said horizontal member;

attachment means for attaching said body portion to a fireplace grate; and spacing means extending through the aperture in said vertical member for contacting the back wall of a fireplace, the spacing means being adjustable with respect to the vertical member such that the position of the grate with respect to the back wall when the spacing means contacts the back wall can be adjusted.

8. A fireplace grate adapter as claimed in claim 7, wherein said horizontal member is apertured, and further comprising a U-shaped support extending through said aperture.

9. A fireplace grate adapter as claimed in claim 8, wherein a section of said U-shaped support extends horizontally, and a support member extends substantially horizontally from the horizontal section of said U-shaped support.

10. A fireplace adapter as in claim 8, wherein the U-shaped support extends through said aperture to the floor of the fireplace, the U-shaped support being supported by the fireplace floor support such that a weight placed on the U-shaped support is borne by the floor and not the body portion.

11. A fireplace grate adapter, comprising:

a body, comprising:

an apertured first vertical member;

a first horizontal member attached at its first end to the upper end of said first vertical member, having an apertured, vertically downwardly extending cut out section;

a second vertical member attached at its first end to the second end of said first horizontal member, extending downwardly from said first horizontal member, having an aperture substantially aligned with the aperture of said cut out section;

a second horizontal member attached at its first end to the second end of said second vertical member, extending toward said first vertical member and having a length less than that of said first horizontal member;

a third vertical member extending upwards from the second end of said second vertical member, having a length less than that of said second vertical member, having an aperture substantially aligned with that of said first vertical member;

attachment means extending through the aperture of said first vertical member and the aperture of said third vertical member for attaching said body to a fireplace grate; and spacing means extending through the aperture of said second vertical member and the aperture of said cut out for contacting the back wall of a fireplace.

12. A fireplace grate adapter as claimed in claim 11, wherein said first horizontal member has an aperture and said second horizontal member has an aperture substantially aligned with that of said first said horizontal member, further comprising a U-shaped support extending through the apertures of said first and second horizontal members.

13. A fireplace grate adapter as claimed in claim 12, further comprising a support member extending substantially horizontally from the horizontal section of said U-shaped support.

14. A fireplace grate adapter as claimed in any one of claims 11 through 13, wherein said attachment means comprises a nut and bolt, and said spacing means comprises a nut, bolt and locknut.

* * * * *